United States Patent [19]

Hanyu et al.

[11] 4,377,980

[45] Mar. 29, 1983

[54] AUTOMATIC THREAD TENSIONING DEVICE FOR SEWING MACHINES

[75] Inventors: Susumu Hanyu; Yoshinobu Tonomura, both of Hachioji, Japan

[73] Assignee: Jánome Sewing Machine Co. Ltd., Tokyo, Japan

[21] Appl. No.: 156,636

[22] Filed: Jun. 4, 1980

[30] Foreign Application Priority Data

Jun. 6, 1979 [JP] Japan ..... 54/69920

[51] Int. Cl.[3] ..... D05B 47/04

[52] U.S. Cl. ..... 112/254; 112/158 E

[58] Field of Search ..... 112/254, 255, 158 E, 112/121.11; 242/150 M, 155 M, 75.4, 156, 156.2

[56] References Cited

U.S. PATENT DOCUMENTS

| | | | |
|---|---|---|---|
| 3,856,233 | 12/1974 | Thomas | 112/254 X |
| 4,166,423 | 9/1979 | Brienza et al. | 112/254 |
| 4,215,641 | 8/1980 | Dobrjanskyj et al. | 112/255 X |

*Primary Examiner*—Peter P. Nerbun

*Attorney, Agent, or Firm*—Michael J. Striker

[57] ABSTRACT

An automatic thread setting device for electronically controlled material and needle position type sewing machines. The device has pattern selecting means, cloth thickness designating means, upper and lower thread tension adjusting means, and electronic memory means. Selection of a pattern automatically sets the thread tension. Selection of a different pattern automatically resets the tension.

5 Claims, 5 Drawing Figures

AUTOMATIC THREAD TENSIONING DEVICE FOR SEWING MACHINES

BACKGROUND OF THE INVENTION

The invention relates to electronic sewing machines in which the lateral swinging movement of the needle and the fabric feeding movement are electronically controlled, and more particularly to a device for such a type of sewing machine for automatically setting the tensions of the upper and lower threads to adequate values in accordance with the selected stitch patterns of different types, besides the manual adjustment of the upper and lower threads.

According to the prior art, the tensions of the upper and lower threads of a sewing machine are generally adjusted firstly by manually appropriately determining the tension of the lower thread in dependence upon the thickness of a fabric to be sewn, and then by setting the tension of the upper thread in such a manner that the upper thread tensioning device is manually operated to provide a provisional upper thread tension, with which the fabric is actually sewn to see if the upper and lower threads are interlocked substantially in the intermediate point of the thickness of the fabric. Some of the conventional sewing machine are provided with a device for automatically adjusting only the upper thread in accordance with the selected stitch patterns of different types. It is, however, to be noted that the optimum value of the upper thread tension should be drawn out of the consideration with respect to the lower thread tension.

This invention has been provided to eliminate the defects and disadvantages of the prior art. It is a primary object of the invention to automatically and appropriately adjust the tensions of the upper and lower threads of a sewing machine in accordance to the selected patterns of different types, and in accordance to the thicknesses of the fabrics to be sewn. More particularly, it is another object of the invention to automatically adjust the tensions of the upper and lower threads of the sewing machine in accordance to a selected pattern, for example, a pattern of pin-tack stitches which is formed by the twin needles accompanied by shrinks of the fabric between the two stitch lines, and in accordance to another pattern, for example, a button hole of pearl stitches as shown in FIG. 6 which is formed in such a manner that the tension of the lower thread is weaker than that of the upper thread, so that the interlocking points of the upper and lower threads may be exposed on the upper face of the fabric and the loops of the lower thread may hem up the cut-out buttonhole edges to consolidate the same.

The other features and advantages of the invention will be apparent from the following description of the preferred embodiment in reference to the attached drawings.

DESCRIPTION OF THE PREFERRED EMBODIMENT

Figure 1:
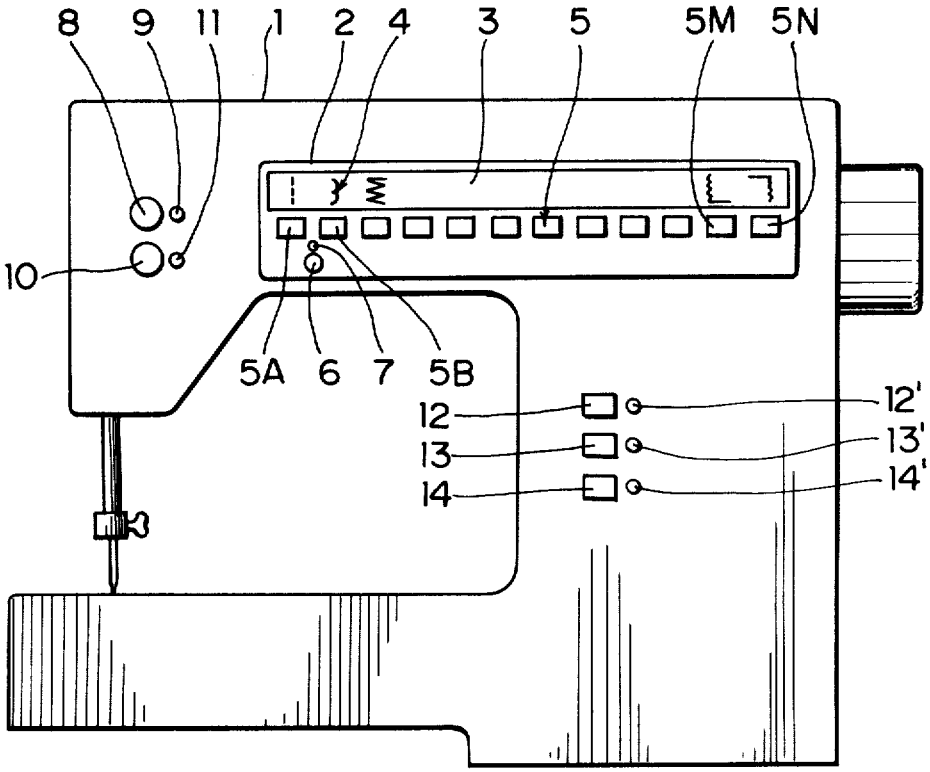
FIG. 1 is a schematic front elevational view of a sewing machine embodying the invention.

In reference to FIG. 1, the reference numeral 1 denotes a machine housing. The numeral 2 denotes a panel provided with a laterally elongated part 3 which is transparent and printed with various patterns 4 to be selectively sewn. These patterns are selectively indicated by lamps in a known manner which are selectively lighted by operating the correspondingly arranged pattern selecting buttons 5. Among the pattern selecting buttons 5, the button 5A is for selecting the straight stitches, and the button 5B is for selecting a scallop stitch pattern. A thread tension changeover button 6 is provided for the straight stitches and the scallop stitch pattern. The button 6 is operated, after the button 5A or 5B is operated, to tighten the tensions of the upper and lower threads for the pattern selected by the button, and this is indicated by a lamp 7. The lamp 7 is shut off upon depressing another one of the pattern selecting buttons 5. Selection buttons 5M and 5N are respectively provided for selecting a set of a lower bar-tuck and a left line-tuck and a set of an upper bar-tuck and a right-line tuck for a pearl stitch button hole. Designated as 8 is a manually operated upper thread tension adjustment dial. By depressing this dial 8 it becomes possible to set a thread tension, and a display lamp 9 is turned on. In this state, by turning the dial the upper thread tension can be adjusted independently of the selected patterns. By subsequently operating one of the selection buttons 5, that state is switched over to the state of automatically selected thread tension set for the selected pattern. Designated as 10 is a manually operated lower thread tension adjustment dial, and as 11 a display lamp therefor. By operating this dial, a similar effect is provided as in the case of the upper thread adjustment dial 8. Designated as 12, 13 and 14 are manually operated buttons for setting the thread tensions for a thick fabric, a medium fabric and a thin fabric respectively, and 12', 13' and 14' denote the corresponding display lamps.

Figure 2:
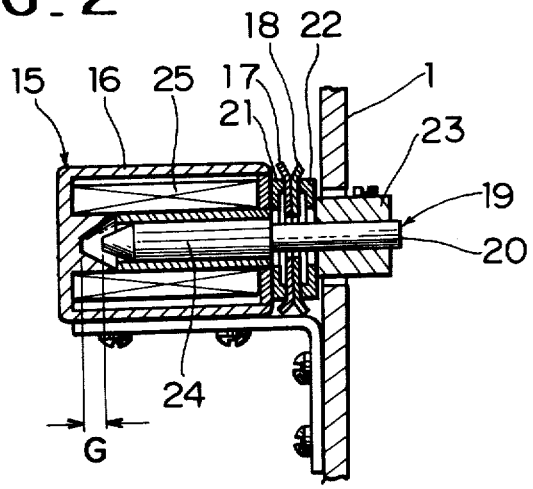
FIG. 2 is a sectional view of an upper thread tension adjuster.

FIG. 2 shows the construction of an upper thread tension adjuster. Designated as 15 is a plunger type solenoid having a stator 16 secured to the machine body 1. Designated as 17 and 18 are thread adjustment discs serving as upper thread tension adjustment members. They are fitted on a small-diameter section 20 of a plunger 19 of the solenoid 15, and they are clamped between a support plate 21 and a keep plate 22 also fitted on that section and slightly movable in the axial direction between one side surface of the stator 16 and machine body 1. Designated as 23 is a lock piece for restricting the relative movement of the keep plate 22 toward the end of the small-diameter section 20. Its position in the axial direction is adjustable, and it is secured to the small-diameter section 20 by a set screw. In mounting these parts, a slight gap is provided such that the thread adjustment discs 17 and 18 will not be urged between the lock piece 23 and a large-diameter section 24 of the plunger 20. Designated as 25 is a coil of the solenoid 15, the exciting current through which is controlled. The residual gap G left ahead of the plunger 19 when the thread adjustment discs 17 and 18 are clamped with the excitation of the solenoid 15 is adjustable with the lock piece 23. The adjustment is made such that by, for instance, increasing the gap G the clamping force exerted to the thread adjustment discs 17 and 18 is reduced with the same excitation. This permits ready adjustment of the clamping force, as the solenoid 15 is used in that the attracting force is gently changed with changes in the residual gap G.

Figure 3:
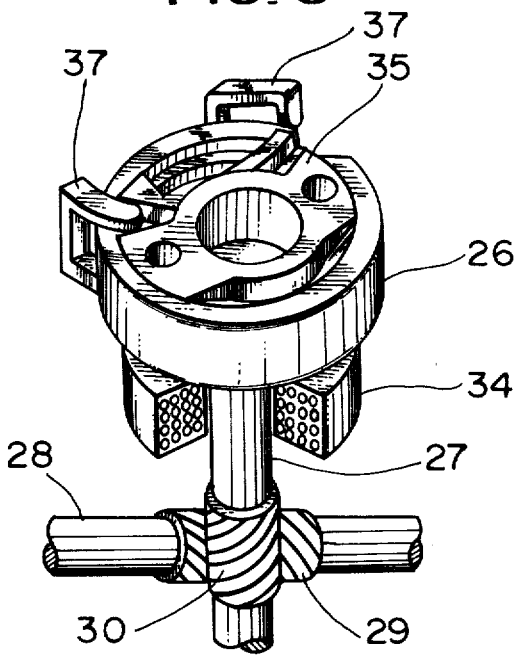
FIG. 3 is a perspective view of the a loop taker of horizontal type.
Figure 4:
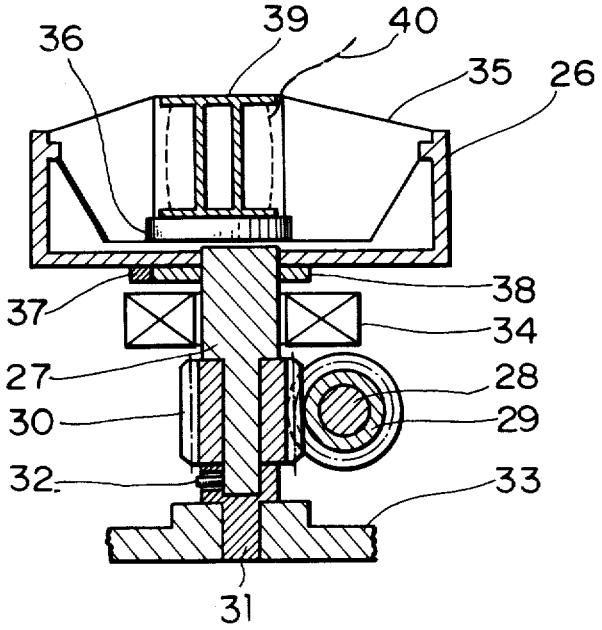
FIG. 4 is a vertical section of the loop taker.

FIG. 3 is a perspective view of a horizontal type loop taker of the sewing machine, and FIG. 4 shows a sectional view of the loop taker including a lower thread tension adjustment section. In FIGS. 3 and 4, designated as 26 is a rotational loop taker with a vertical shaft 27 made of a magnetic material. The loop taker 26 is rotated by rotation of the lower shaft 28 transmitted thereto through gears 29 and 30. Designated as 31 is an auxiliary shaft made of a non-magnetic material coaxially coupled by a screw 32 to the vertical shaft 27. Designated as 33 is a bearing which is integral with the machine housing 1. Designated as 34 is an energizing coil. The energizing coil 34 is arranged around the vertical shaft 27, and the energizing current is controlled. In FIG. 3, the energizing coil 34 is shown partly in section. Designated as 35 is a bobbin carrier which is made of a synthetic resin. The bottom 36 of the bobbin carrier 35 is made of a magnetic material. The bobbin carrier is prevented from rotation by a rockable member with a pair of arms 37. As shown, the bobbin carrier 35 is held in the loop taker 26 with a space between the bottom 36 and the vertical shaft 27, so that the bobbin carrier 35 may remain stationary during the rotation of the loop taker 26.  The eccentric cam 38 is made of a non-magnetic material. Designated as 39 is a bobbin made of a magnetic material. The bobbin 39 has the lower thread wound therearound as shown by dashed lines. Designated as 40 is the end of the lower thread. The bobbin 39 is turned in the bobbin carrier 35 as the lower thread 40 is pulled out. The vertical shaft 27, the bottom 36 of bobbin carrier 35 and bobbin 39, all being made of a magnetic material, constitute a magnetic path extending through the center of the energizing coil 34 and between the opposite ends of this path in the space on the outside of the energizing coil 34. The amount of magnetic flux is changed with a change in the amount of energizing current in the coil 34, and the friction force between the bobbin carrier bottom 36 and the bobbin 39 is changed with the magnetic force of attraction between them. The auxiliary shaft 31** is made of a non-magnetic material to eliminate magnetic attraction at the frictional surface.

Designated ar 38 is an eccentric cam mounted on the vertical shaft 27 to lock the arms 37, so as to prevent the rotation of the bobbin carrier 35 and to allow the upper thread to be drawn out of the loop taker 26**.

Figure 5:
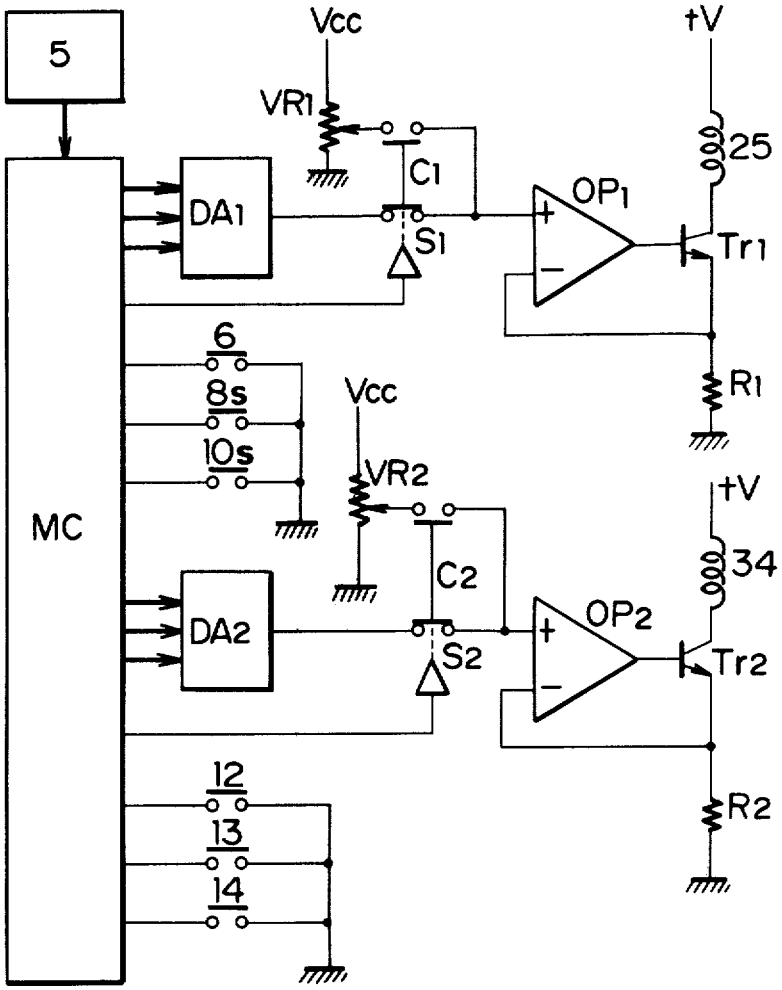
FIG. 5 is a diagrammatic view of a control circuit of the invention.

FIG. 5 shows a circuit diagram of a control circuit. Designated at MC is a microcomputer, which may be, for instance, a commercially available 8080 system. It memorizes in an internal electronic memory stitch control signals for the stitch patterns selected by the respective pattern selection buttons 5 and upper and lower thread tension indicating signals required for each pattern.

Designated at $DA_1$ is a digital-to-analog converter for converting a three-bit digital signal indicating the upper thread tension into an analog signal. The three-bit digital signal is produced from the microcomputer MC after it receives the operation signals produced by the operation of one of the pattern selection buttons 5 and one of the cloth thickness indicating buttons 12, 13 and 14 or by the operation of a stitch selection button and the subsequent operation of the thread tension changeover button 6. Designated at $S_1$ is an analog switch with a contact $C_1$ which is brought to its illustrated lower position with the operation of a pattern selection button 5 and is brought to its upper position when a switch $8_s$ is closed by the depression of the manually operated upper thread tension adjustment dial 8. When the aforementioned contact $C_1$ is in the lower position, it makes the output of the digital-to-analog converter $DA_1$ effective with respect to a non-inversion input terminal (+) of an operational amplifier $OP_1$, while in its upper position it makes effective a variable resistor VR, which is adjusted with the rotation of the manually operated, upper thread tension adjustment dial 8. The variable resistor is connected at one end to a control voltage source Vcc, and its output enables the adjustment of the tension in a weaker range inclusive of the range of data provided by the digital-to-analog converter $DA_1$. When the input data coupled to the digital-to-analog converter $DA_1$ is produced by operation of one of the stitch selection buttons 5, the microcomputer MC makes the same designation as when the medium cloth thickness indication button 13 is operated. Thus, in this case the lower thread tension is set to a medium value, while the upper thread tension is set to a value for the selected stitch in a range of values which are not particularly high. When the thread tension changeover button 6 is operated concurrently, a comparatively high tension is provided for both the upper and lower threads. The cloth thickness indication buttons 12, 13 and 14 respectively specify strong, medium and weak tension values for the lower thread, and during operation the upper thread tension is correspondingly automatically set. The output terminal of the operational amplifier $OP_1$ is connected to the base of a transistor $Tr_1$, which has its collector connected to an upper thread tension control energizing coil 25 receiving a source voltage +V, and its emitter grounded through a resistor $R_1$ and also connected to a non-inversion input terminal (−) of the operational amplifier $OP_1$. A control circuit for an energizing coil 34 for the lower thread tension control has a similar construction to the upper thread tension control circuit. To describe this briefly, designated as $DA_2$ is a digital-to-analog converter, $S_2$ is an analog switch with its contact means $C_2$ similarly brought to the upper and lower positions with the operation of a stitch selection button 5 and the operation of a switch $10_s$, effected by depressing the manually operated lower thread tension adjustment dial 10. $VR_2$ is a variable resistors which is adjustable by turning the manually operated lower thread tension adjustment dial 10. Designated as $OP_2$ is an operational amplifier, $Tr_2$ is a transistor, and $R_2$ is a resistor. Regarding the input data to the digital-to-analog converter $DA_2$, in a manner analogous to the above case, a comparatively low value of tension is set upon operation of one of the pattern selection buttons 5, and a comparatively high value is set upon concurrent operation of the thread tension changeover button 6.

With the above construction, if one of the stitch selection buttons 5 except for the buttons 5M and 5N is operated, a designated pattern is selected, and a lamp is lighted to indicate the selected pattern in the pattern indicating part 3. Although not shown in FIG. 5, the microcomputer MC in the control circuit is adapted to provide the stitch control signals of the selected pattern to the stitch forming unit (not shown). Also, with respect to the large- and medium-thickness cloth designations, the microcomputer provides three-bit signals designating adequate upper and lower thread tensions for the selected stitch to the digital-to-analog converters $DA_1$ and $DA_2$. These signals set the upper thread tension to an adequate value for the selected stitch patterns in such a manner that the point of interlock of the upper and lower threads is positioned in the center of the thickness of the cloth to the sewn. This data is converted in the digital-to-analog converters $DA_1$ and $DA_2$ into corresponding analog values constituting the inputs to the operational amplifiers $OP_1$ and $OP_2$, whereby the coils 25 and 34 of the respective solenoids are excited with the current values based upon the analog values to effect setting of the tensions of the upper and lower threads.

Figure 6:
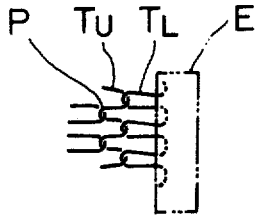
FIG. 6 is a pattern of stitches, shown as an example, by the invention.

When the pattern selection button 5M or 5N, which designate the pearl stitch button hole, are selected, the microcomputer MC sets a weak tension for the lower thread and a strong tension for the upper thread. In consequence, in the stitch formation the interlocking points P, the lower thread $T_L$ and the upper thread $T_U$ are raised over the upper surface of the cloth as shown in FIG. 6, and the cut edge E of the button hole in the cloth is hemstitched and reinforced by the lower thread $T_L$ to prevent the raveling of cloth. When the material is thick, the friction of the thread as it penetrates the cloth is increased, so that it is necessary to increase the thread tension. In this case, the large-thickness cloth designating button 12 is operated after the operation of the pattern selection button 5. By so doing, the microcomputer MC sets a strong tension for the lower thread and also sets a corresponding suitable tension for the upper thread. When the material is thin, shrinkage is liable to result, so that it is necessary to set a weak tension for the threads. In this case, the small-thickness cloth designating button 14 is operated, whereby a weak tension is set for the upper and lower threads. The medium-thickness cloth designating button 13 is provided for resetting the designations by the buttons 12 and 14 to that for the ordinary cloth thickness, and its operation can be replaced by operation of any of the pattern selection buttons 5 afresh. By operating the thread tension changeover button 6 after the operation of the pattern selection button 5A or 5B, the microcomputer MC sets a strong tension for both the upper and lower threads. In the case of the pin tuck stitch, in which the stitch is formed by a twin-needle with two upper threads, a strong tension set for the lower thread, which is common to both the upper threads, acts between two tuck lines formed by the two parallel needles to produce a tuck shrinkage or so-called pin tuck stitch. By operating a stitch selection button 5 afresh at this time, the stitch with the ordinary thread tension is recovered. By depressing the manually operated upper thread tension adjustment dial 8 (or manual lower thread tension adjustment dial 10), the microcomputer MC brings the contact $C_1$ (or $C_2$) of the switch $S_1$ (or $S_2$) to the upper position, to render the variable resistor $VR_1$ (or $VR_2$) effective for manual adjustment of the tension in each thread. Particularly, the manual upper thread tension adjustment dial can adjust the upper thread tension to be very weak for basting. By operating a stitch selection button 5 afresh, the ordinary automatically set thread tension is recovered.

It will be understood that each of the elements described above, or two or more together, may also find a useful application in other types of sewing machine control mechanisms differing from the types described above.

While the invention has been illustrated and described as embodied in a device for automatically setting the tensions of the upper and lower threads to adequate values in accordance with the selected stitch pattern, besides the manual adjustment of the upper and lower threads, it is not intended to be limited to the details shown, since various modifications and structural changes may be made without departing in any way from the spirit of the present invention.

Without further analysis, the foregoing will so fully reveal the gist of the present invention that others can by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a sewing machine, in which the relative position of the material and needle is electronically controlled, an automatic thread tension setting device for said sewing machine, comprising pattern selecting means selectably operated to select a desired one from a plurality of different patterns, including a plurality of stitch selection buttons for selecting respectively different stitches, the thread tension being automatically set by the selection of one of said stitch selection buttons, including a straight stitch button and a scallop stitch button, and also wherein said pattern selecting means further include a thread tension switch button common to said straight stitch and scallop stitch buttons for increasing the thread tension, the operation of said switch button after the operation of either said straight stitch or scallop buttons being effective to cause setting of a strong tension in both the upper and lower threads for the selected stitch, the setting of said strong tension being cancelled with the operation of one of said stitch selection buttons afresh, cloth thickness designating means for designating the thickness of the material, upper thread tension adjusting means for electromagnetically adjusting the upper thread tension, lower thread tension adjusting means for electromagnetically adjusting the lower thread tension, and electronic memory means for memorizing control signals for controlling said upper and lower thread tension adjusting means in accordance with the operation of said pattern selecting means or a combination of the operation of said stitch selection means and the operation of said cloth thickness designating means.

2. In a sewing machine, in which the relative position of the material and needle is electronically controlled, an automatic thread tension setting device for said sewing machine, comprising pattern selecting means selectively operated to select a desired one from a plurality of different patterns, cloth thickness designating means designating the thickness of the material, including selection buttons for designating the lower thread tension at least for large-thickness, and small-thickness materials respectively, the upper thread tension being automatically set with the operation of any one of said selection buttons, upper thread tension adjusting means for electromagnetically adjusting the upper thread tension, lower thread tension adjusting means for electromagnetically adjusting the lower thread tension, and electronic memory means for memorizing control signals for controlling said upper and lower thread tension adjusting means in accordance with the operation of said pattern selecting means or a combination of the operation of said stitch selection means and the operation of said cloth thickness designating means.

3. The automatic thread tension setting device according to claim 1 or 2, wherein said upper thread tension adjusting means includes a coil provided in a solenoid, the exciting current through said coil being controlled.

4. The automatic thread tension setting device according to claim 3, wherein a residual gap ahead of a plunger when thread adjustment discs are clamped with the excitation of said solenoid is adjustable with a lock piece, the force of clamping said thread adjustment discs being reduced by increasing the aforesaid gap with the same excitation.

5. The automatic thread tension setting device according to claim 1 or 2, wherein said lower thread tension adjusting means include an energizing coil coaxially mounted on a vertical shaft rotatably mounted on the machine body, the exciting current through said energizing coil being controlled.

* * * * *